US006790032B1

(12) United States Patent
Wu et al.

(10) Patent No.: US 6,790,032 B1
(45) Date of Patent: Sep. 14, 2004

(54) STRAIGHT PATH CARBON POWDER COMBUSTION MACHINE

(76) Inventors: Kuo-Yu Wu, 235 Chung-Ho Box 8-24, Taipei (TW); Chen-Yi Lin, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/338,612

(22) Filed: Jan. 6, 2003

(51) Int. Cl.[7] ..... F23M 9/00

(52) U.S. Cl. ..... 431/182; 431/185; 431/187; 110/234; 110/261; 110/264

(58) Field of Search ..... 431/4, 9, 182, 431/185, 187, 173, 284, 184; 239/400, 406, 405, 402; 110/264, 263, 265, 347, 261

(56) References Cited

U.S. PATENT DOCUMENTS 4,157,889 A * 6/1979 Bonnel ..... 431/182
4,350,103 A * 9/1982 Poll ..... 110/264
4,373,900 A * 2/1983 Eckelmann ..... 431/182
4,597,342 A * 7/1986 Green et al. ..... 110/347
4,748,919 A * 6/1988 Campobenedetto et al. 110/264

* cited by examiner

*Primary Examiner*—James C. Yeung

(57) ABSTRACT

A straight path carbon powder combustion machine uses carbon powders as fuel of the combustion machine. The carbon powders enter into the interior of an igniter from carbon powders inlets. Then the carbon powders further enter into a forced firing internal combustion chamber. The gas in the gas tube of the igniter is fired by an electric shock rod. Part of air input from the whirlwind combustion air inlet to mix in the forced firing internal combustion chamber. When the gas in the igniter is fired by the electric shock rod, the fire jets out from the gas combustion air inlet tube so as to fire the carbon powders. The carbon powders are intercepted by the tinder intercepter to adhere thereon. The carbon powders contact and are fired by the tinder on the tinder intercepter to form a large flame which is sprayed out from the plurality of flame outlets.

1 Claim, 4 Drawing Sheets

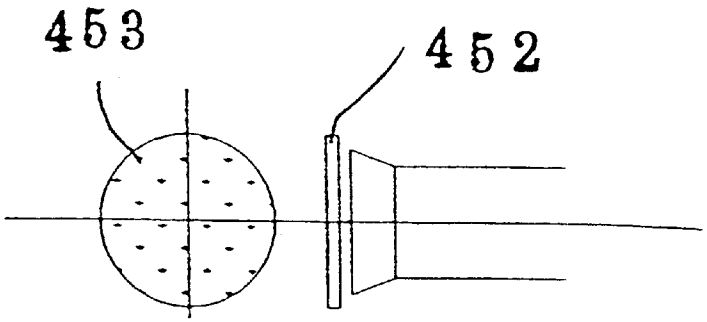
Fig. 3-(A)
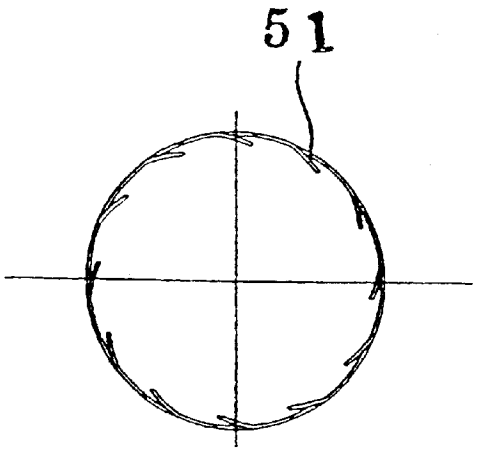
See A-A
Fig. 3-(B)

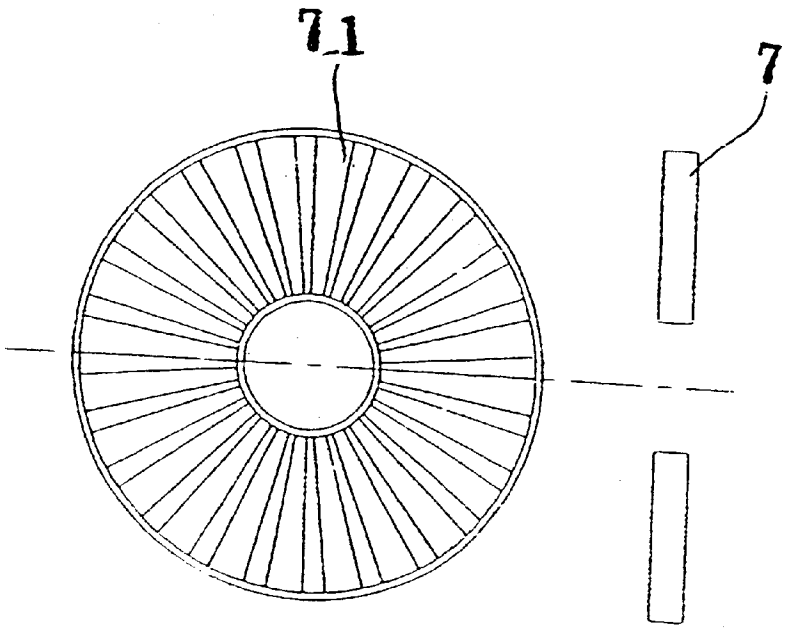
Fig. 3-(D)
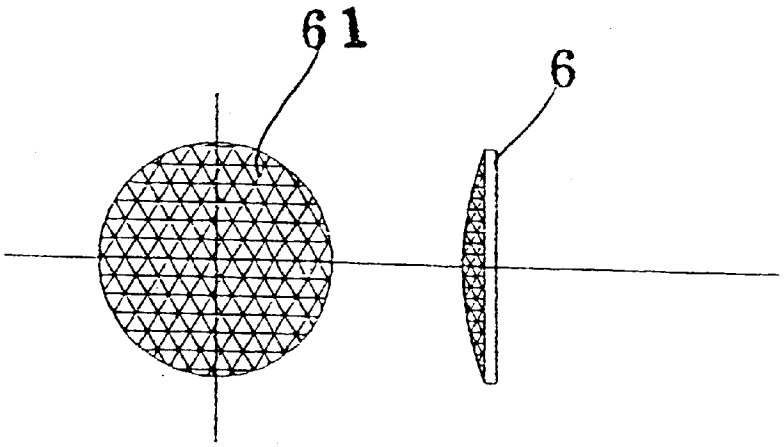
Fig. 3-(C)
Replacement Sheet

STRAIGHT PATH CARBON POWDER COMBUSTION MACHINE

BACKGROUND OF THE INVENTION

The present invention relates to combustion machines, and particularly to a straight path carbon powder combustion machine, in that the carbon power is used to replace the conventional heavy oil and diesel oil.

Currently, combustion machine placed before a grout mixer, a stone dryer, or an incinerator, etc. uses heavy oil or diesel oil. However, the cost is high. Moreover, the heavy oil can not be burned completely so that residues are remained in the components of the combustion machine. To clean the residues are inconvenient, even the combustion machine will be damaged due to the accumulation of oil residus.

SUMMARY OF THE INVENTION

Accordingly, the primary object of the present invention is to provide a straight path carbon powder combustion machine which comprises a body, an air inlet device, an igniter, a forced firing internal combustion chamber, a tinder intercepter and an external combustion chamber.

The body has a hollow interior for receiving other components; and a front end of the body is formed with an outlet for ejecting flame.

The air inlet device is connected to a periphery of the distal end of the body. An outlet of the blower is installed with an air inlet door for controlling airflow from the blower to the periphery of the distal end of the body.

The igniter is axially installed to the interior of the distal end of the body. An outer periphery of the igniter is connected with a carbon powder inlet. A gas tube and an electric shock rod serve for firing gas are connected by a pipe. A gas combustion air inlet tube serves to provide gas to the electric shock rod.

The forced firing internal combustion chamber is axially installed in an interior of the middle and front sections of the body. A distal end of the forced firing internal combustion chamber is connected to an outer edge of the front end of the igniter. The distal end of the forced firing internal combustion chamber is annually installed with a whirlwind combustion air inlet. A front end of the whirlwind combustion air inlet is reduced and a plurality of flame outlets are formed at the surface of the whirlwind combustion air inlet.

The tinder intercepter is axially installed in the interior of a front end of the forced firing internal combustion chamber. A surface of the tinder intercepter is formed with a lattice net.

The external combustion chamber is installed in the plurality of flame outlets at a front section of the forced firing internal combustion chamber. A turbulent blade set is installed at an outer edge of the foremost end of the forced firing internal combustion chamber.

The various objects and advantages of the present invention will be more readily understood from the following detailed description when read in conjunction with the appended drawing.

BRIEF DESCRIPTION OF THE DRAWINGS

FIG. 3A is partial a schematic perspective view of the front end of the igniter of the present invention.

FIG. 3B is a schematic view showing the whirlwind combustion air inlet of the forced firing internal combustion chamber of the present invention.

FIG. 3C is a schematic view showing the tinder intercepter of the present invention.

FIG. 3D shows the turbulent blade set at the front end of the forced firing internal combustion chamber of the present invention.

DETAILED DESCRIPTION OF THE PREFERRED EMBODIMENTS

Figure 1:
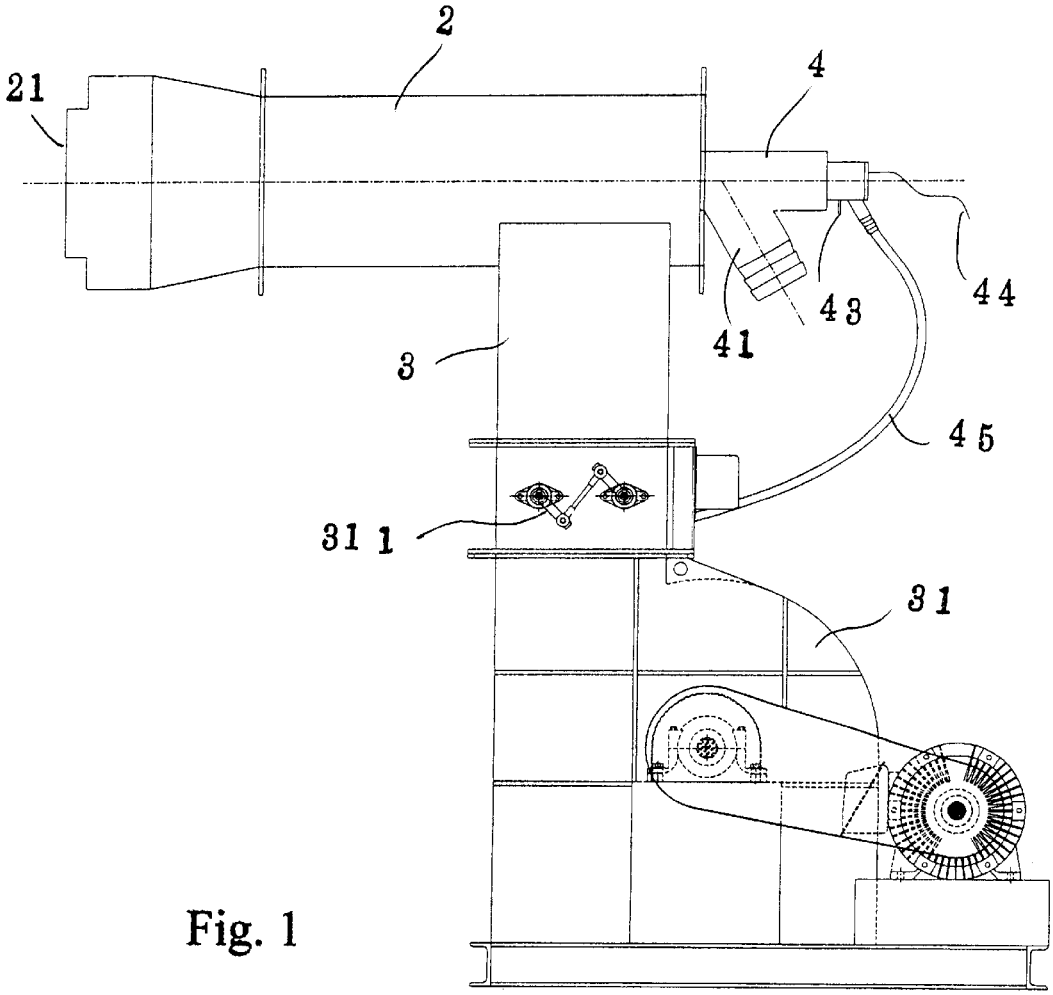
FIG. 1 is a plane schematic view showing the structure of the present invention.

Referring to FIGS. 1, 2, 3A, 3B, 3C, and 3D. The straight path carbon powder combustion machine of the present invention includes a body 2, an air inlet device 3, an igniter 4, a forced firing internal combustion chamber 5, a tinder intercepter 6, and an external combustion chamber 7.

The body 2 has a hollow interior for receiving the igniter 4, forced firing internal combustion chamber, tinder intercepter 6, and external combustion chamber 7 which are axially arranged. A front end of the body 2 is formed with an outlet 21 for ejecting flame.

The air inlet device 3 is connected to a periphery of the distal end of the body 2. Thereby, air used in combustion can be provided by a blower 31 (not shown). An outlet of the blower 31 is installed with an air inlet door 311 for controlling airflow from the blower 31 to the periphery of the distal end of the body 2.

The igniter 4 is axially installed to the interior of the distal end of the body 2. An outer periphery of the igniter 4 is connected with a carbon powder inlet 41. Thereby, the carbon powders A used in combustion enter into an interior of the outer cylinder 42 and then enters into the forced firing internal combustion chamber 5. A gas tube 41 and an electric shock rod 43 for firing gas are connected by a pipe 451 so as to be axially installed in the igniter 4. The foremost end 452 of the igniter 4 is expanded. A plurality of flame outlets 453 are formed at the front end of the foremost end 452. A gas combustion air inlet tube 45 serves to provide gas to the electric shock rod 43. A front end of the gas tube 43 is expanded.

The forced firing internal combustion chamber 5 is axially installed in an interior of the middle and front sections of the body 2. A distal end of the forced firing internal combustion chamber 5 is connected to an outer edge of the front end of the igniter 4. The distal end of the forced firing internal combustion chamber 5 is positioned upon the front end of the flame outlet 453 are annually installed with a whirlwind combustion air inlet 51. Thereby, the carbon powders A flow as whirlwind to enter into the forced firing internal combustion chamber 5 for mixing the carbon powders of fuel. A front end of the whirlwind combustion air inlet 51 is reduced and a plurality of flame outlets 52 are formed at the surface of the whirlwind combustion air inlet 51.

The tinder intercepter 6 is axially installed in the interior of a front end of the forced firing internal combustion chamber 5. A surface of the tinder intercepter 6 is formed with a lattice net 61.

The external combustion chamber 7 is installed in the plurality of flame outlets 52 at a front section of the forced firing internal combustion chamber 5. A turbulent blade set 71 is installed at an outer edge of the foremost end of the forced firing internal combustion chamber 5.

Figure 2:
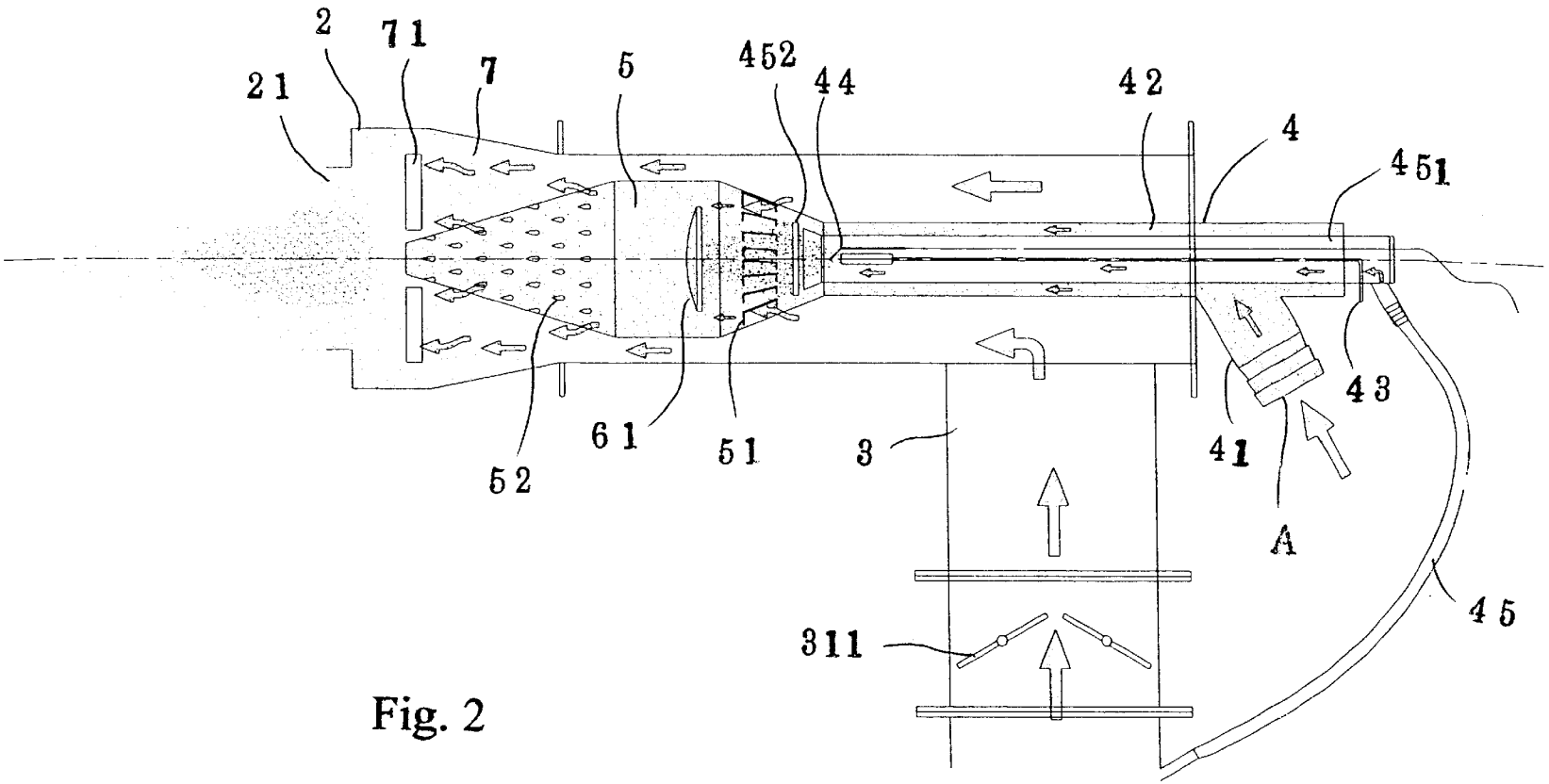
FIG. 2 is a plane schematic view showing the operation of the present invention.

Referring to FIG. 2, the operation of the present invention will be described herein.

By above components, carbon powders can be used as fuel of the combustion machine. The carbon powders enters into the interior of the igniter 4 from the carbon powders inlets 41. Then they further enter into the forced firing internal combustion chamber 5. The gas combustion air inlet tube 45 is opened. The gas in the gas tube 41 of the igniter 4 is fired by the electric shock rod 43. The air inlet device 3 at the distal end of the body provides air. Part of air input from the whirlwind combustion air inlet 51 to mix in the forced firing internal combustion chamber 5. When the gas in the igniter 4 is fired by the electric shock rod 43. The fire jets out from the gas combustion air inlet tube 45 so as to fire the carbon powders at the front end and are mixed with air. The carbon powders A are intercepted by the tinder intercepter 6 so as to adhere thereon as a tinder for firing other carbon powders. When the carbon powders upon the tinder intercepter 6 are accumulated to a predetermined amount, the gas of the igniter 4 is closed. The carbon powders contact and are fired by the tinder on the tinder intercepter 6 to form a large flame which is sprayed out from the plurality of flame outlets 52.

If the flame sprayed from the outlets 52 have some carbon powders. The external combustion chamber 7 can provide further air through the air inlet device 3. Then the air is mixed with the unburned carbon powders so that the carbon powders can be burned completely. Finally, the flame sprays out from the foremost outlet 21 of the body 2.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A straight path carbon powder combustion machine comprising a body, an air inlet device, a forced firing internal combustion chamber, a tinder intercepter, and an external combustion chamber, wherein:

the body has a hollow interior for receiving an igniter, the forced firing internal combustion chamber, the tinder intercepter, and the external combustion chamber which are axially arranged; a front end of the body is formed with an outlet for ejecting flame;

the air inlet device is connected to a periphery of a distal end of the body; thereby, air used in combustion is provided by a blower; an outlet of the blower is installed with an air inlet door for controlling airflow from the blower to the periphery of the distal end of the body;

the igniter is axially installed to an interior of the distal end of the body; an outer periphery of the igniter is connected with a carbon powder inlet; thereby, the carbon powders used in combustion enter into an interior of an outer cylinder and then enter into the forced firing internal combustion chamber; a gas tube and an electric shock rod for firing gas are connected by a pipe so as to be axially installed in the igniter; a foremost end of the igniter is enlarged; a plurality of flame outlets are formed at a front end of the foremost end; a gas combustion air inlet tube serves to provide gas to the electric shock rod;

the forced firing internal combustion chamber is axially installed in an interior of middle and front sections of the body; a distal end of the forced firing internal combustion chamber is connected to an outer edge of the front end of the igniter; the distal end of the forced firing internal combustion chamber is positioned upon the front end of the flame outlet and is annually installed with a whirlwind combustion air inlet; thereby, the carbon powders flows as whirlwind to enter into the forced firing internal combustion chamber for mixing the carbon powders of fuel; a front end of the whirlwind combustion air inlet is reduced and a plurality of flame outlets are formed at a surface of the whirlwind combustion air inlet;

the tinder intercepter is axially installed in an interior of a front end of the forced firing internal combustion chamber; a surface of the tinder intercepter is formed with a lattice net; and the external combustion chamber is installed in the plurality of flame outlets at a front section of the forced firing internal combustion chamber; a turbulent blade set is installed at an outer edge of a foremost end of the forced firing internal combustion chamber;

wherein the straight path carbon powder, combustion machine, utilizes carbon powders as fuel and the combustion process is complete.

* * * * *